US009429304B2

(12) United States Patent
Masuda et al.

(10) Patent No.: US 9,429,304 B2
(45) Date of Patent: Aug. 30, 2016

(54) LIGHT EMITTING MODULE AND VEHICLE LAMP

(71) Applicants: Takeshi Masuda, Shizuoka (JP); Masanobu Mizuno, Shizuoka (JP); Yasuaki Tsutsumi, Shizuoka (JP)

(72) Inventors: Takeshi Masuda, Shizuoka (JP); Masanobu Mizuno, Shizuoka (JP); Yasuaki Tsutsumi, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 380 days.

(21) Appl. No.: 13/750,351

(22) Filed: Jan. 25, 2013

(65) Prior Publication Data

US 2013/0188375 A1 Jul. 25, 2013

(30) Foreign Application Priority Data

Jan. 25, 2012 (JP) ..... 2012-013523

(51) Int. Cl.

| | |
|---|---|
| ***F21V 29/00*** | (2015.01) |
| ***F21V 21/00*** | (2006.01) |
| ***F21V 5/04*** | (2006.01) |
| ***F21S 8/10*** | (2006.01) |

(52) U.S. Cl.

CPC ..... *F21V 21/00* (2013.01); *F21S 48/1109* (2013.01); *F21S 48/1154* (2013.01); *F21S 48/1747* (2013.01); *F21S 48/1784* (2013.01); *F21V 5/04* (2013.01); *F21S 48/325* (2013.01)

(58) Field of Classification Search

CPC ..... F21S 48/1736; F21S 48/211; F21S 48/1109; F21S 48/1154; F21S 48/1747; F21V 21/00

USPC ..... 362/544; 315/250; 257/93

See application file for complete search history.

(56) References Cited

U.S. PATENT DOCUMENTS 6,406,173 B1 * 6/2002 Serizawa et al. ..... 362/545
6,462,669 B1 * 10/2002 Pederson ..... 340/815.45

(Continued)

FOREIGN PATENT DOCUMENTS

CN 101431844 A 5/2009
CN 101852417 A 10/2010

(Continued)

OTHER PUBLICATIONS

English Patent Abstract of JP 2008524045, from esp@cenet; Publication Date: Jul. 10, 2008 (1 Page).

(Continued)

*Primary Examiner* — Evan Dzierzynski
*Assistant Examiner* — Matthew Peerce
(74) *Attorney, Agent, or Firm* — Osha Liang LLP

(57) ABSTRACT

A light emitting module includes a board on which a plurality of light emitting devices are mounted, a first interconnecting section having first interconnections, one end of each of which being connected to one of an anode side and an cathode side of an associated one of the light emitting devices, a second interconnecting section having second interconnections, one end of each of which being connected to the other of the anode side and the cathode side of an associated one of the light emitting devices, and a power supply portion provided along one side of the board to receive an external power. The second interconnecting section has at least one, but less than the number of the second interconnections, collectively interconnecting portion to which another end of each of the second interconnections is connected.

10 Claims, 5 Drawing Sheets

(56) References Cited

U.S. PATENT DOCUMENTS

| | | | | |
|---|---|---|---|---|
| 6,715,909 | B2 * | 4/2004 | Serizawa | 362/545 |
| 7,789,530 | B2 * | 9/2010 | Stein et al. | 362/249.14 |
| 7,883,251 | B2 * | 2/2011 | Ansari et al. | 362/547 |
| 8,174,033 | B2 * | 5/2012 | Yoneda et al. | 257/88 |
| 2003/0179585 | A1 * | 9/2003 | Lefebvre | 362/544 |
| 2004/0202006 | A1 * | 10/2004 | Pien | 362/545 |
| 2010/0290241 | A1 * | 11/2010 | Tsukamoto | 362/519 |
| 2010/0320928 | A1 * | 12/2010 | Kaihotsu | H01L 25/0753 315/250 |
| 2012/0248982 | A1 * | 10/2012 | Liao | 315/77 |
| 2013/0027637 | A1 * | 1/2013 | Hosoki | G02F 1/133615 349/69 |
| 2013/0163270 | A1 * | 6/2013 | Burgin | 362/544 |
| 2013/0271020 | A1 * | 10/2013 | Kim | 315/192 |

FOREIGN PATENT DOCUMENTS

| | | | | |
|---|---|---|---|---|
| GB | 2473311 | A | 3/2011 | |
| JP | 2008524045 | A | 7/2008 | |
| JP | 2008210944 | A | 9/2008 | |
| JP | 2009521077 | A | 5/2009 | |
| JP | WO 2011086761 | A1 * | 7/2011 | G02F 1/133615 |
| JP | 2011201400 | A | 10/2011 | |
| WO | 2011/042999 | A1 | 4/2011 | |
| WO | 2011059664 | A2 | 5/2011 | |

OTHER PUBLICATIONS

First Office Action issued in corresponding Chinese Application No. 201310027476.X, mailed on Feb. 28, 2015 (15 pages).

Office Action issued in corresponding Japanese Application No. 2012-013523, mailed on Aug. 18, 2015 (8 pages).

Notification of Reasons for Refusal issued in corresponding Japanese Application No. 2012-013523, mailed on Mar. 22, 2016 (17 pages).

* cited by examiner

10

LIGHT EMITTING MODULE AND VEHICLE LAMP

CROSS-REFERENCE TO RELATED APPLICATIONS

The present application claims priority from Japanese Patent Application No. 2012-013523 filed on Jan. 25, 2012, the entire content of which is incorporated herein by reference.

BACKGROUND OF INVENTION

1. Field of the Invention

The present invention relates to a light emitting module and a vehicle lamp having the light emitting module.

2. Related Art

For safety reasons, vehicle lamps are required to produce prescribed light distribution patterns. For example, vehicle headlamps are required to produce an oblong light distribution pattern irradiating a region extending in a vehicle width direction such that the center part of the region is irradiated brighter than a peripheral part of the region.

In related art vehicle lamps, semiconductor light emitting devices such as light emitting diodes (LED) are used as a light source. When using an LED as a light source of a vehicle headlamp, it is difficult to produce a light distribution pattern having a required light quantity and shape with a single LED. In view of this, a related art light source module has a plurality of series-connected LEDs arranged in a row (see, e.g., JP 2008-524045 A).

To produce various light distribution patterns using a single unit, a light emitting module may be configured to have an array of LED chips arranged in a matrix manner.

However, as the number of LED chips arranged in an array form increases, the number of interconnections, the board size, and the number of connectors are likely to increase accordingly.

SUMMARY OF INVENTION

One or more embodiments of the present invention provide a simple and compact light emitting module having an array of light emitting devices.

According to one or more embodiments of the present invention, a light emitting module is provided. The light emitting module includes a board having a mounting portion, the mounting portion being configured such that a plurality of light emitting devices, each of the light emitting devices having an anode side and a cathode side, are mounted on the mounting portion in an array form, a first interconnecting section having a plurality of first interconnections, the first interconnections being configured such that one end of each of the first interconnections is connected to one of the anode side and the cathode side of an associated one of the light emitting devices, a second interconnecting section having a plurality of second interconnections, the second interconnections being configured such that one end of each of the second interconnections is connected to the other of the anode side and the cathode side of an associated one of the light emitting devices, and a power supply portion provided along one side of the board and configured to receive an external power. The second interconnecting section has at least one, but less than the number of the second interconnections, collectively interconnecting portion to which another end of each of the second interconnections is connected. The first interconnecting section and the second interconnecting section are configured such that another end of each of the first interconnections and an end portion of the collectively interconnecting portion are connected to the power supply portion, and such that the light emitting devices are divided into a plurality of groups that are independently controllable to be turned on and off.

According to one or more embodiments of the present invention, a vehicle lamp is provided. The vehicle lamp includes the light emitting module described above, a control unit configured to control each of the groups to turn the light emitting devices on and off on a group-by-group basis, an optical member configured to forwardly project light emitted from the light emitting module, and a lamp body accommodating the light emitting module and the optical member.

Other aspects and advantages of the invention will be apparent from the following description, the drawings and the claims.

DETAILED DESCRIPTION

Hereinafter, embodiments of the present invention will be described in detail with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
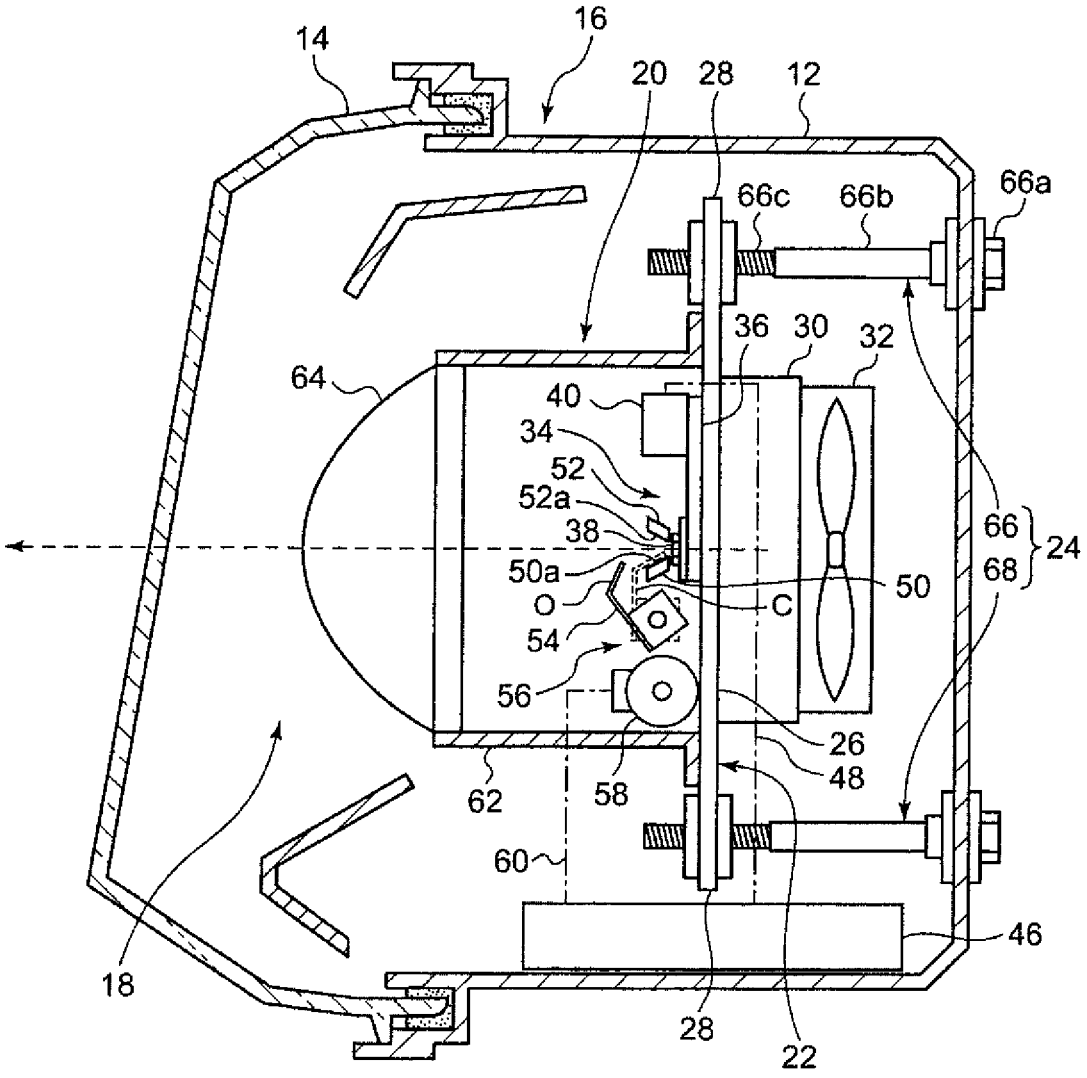
FIG. 1 is a schematic vertical sectional view of a vehicle lamp according to one or more embodiments of the present invention.
Figure 2:
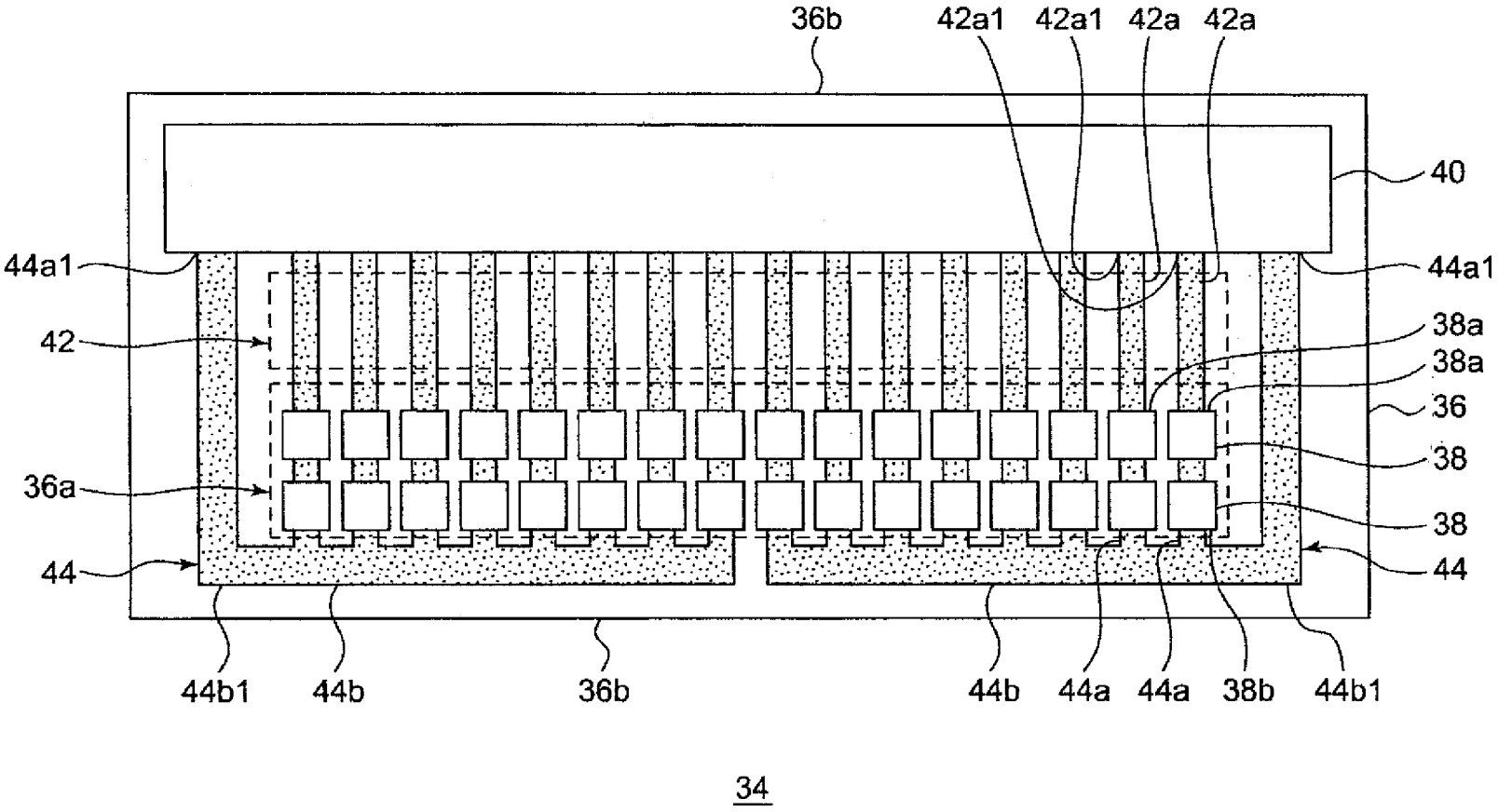
FIG. 2 is a front view of an example of a light emitting module of the vehicle lamp.

FIG. 1 is a schematic vertical sectional view of a vehicle lamp 10 according to one or more embodiments of the present invention. FIG. 2 is a front view of an example of a light emitting module 34 of the vehicle lamp 10. The vehicle lamp 10 is a headlamp of a vehicle.

The vehicle lamp 10 is disposed at each lateral side of a front end portion of a vehicle. As shown in FIG. 1, the vehicle lamp 10 includes a lamp body 12 having a front opening and a cover 14 attached to a front portion of the lamp body 12 to close the opening. The lamp body 12 and the cover 14 form a lamp housing 16, whereby a lamp chamber 18 is provided inside the lamp housing 16.

A lamp unit 20 is disposed inside the lamp chamber 18. The lamp unit 20 is configured to produce a high-beam light distribution pattern. A holding member 22 is disposed inside the lamp chamber 18. An optical axis adjusting mechanism 24 is configured to allow the holding member 22 to turn in the left-right direction and in the front-rear direction. The holding member 22 has a base portion 26 which is made of a metal material having high thermal conductivity. The base portion 26 is arranged to face the front-rear direction.

The base portion 26 is provided with three pivot portions 28 at its top and bottom end portions (only two pivot portions 28 are shown in FIG. 1). Heat dissipating fins 30 are provided to protrude rearward from the rear surface of the base portion 26. A cooling fan 32 is attached to the rear faces of the heat dissipating fins 30.

The light emitting module 34 is attached to a portion of the front surface of the base portion 26 including a central portion and an upper portion of the front surface of the base portion 26. As shown in FIG. 2, the light emitting module 34 has a plurality of semiconductor light emitting devices 38, a circuit board 36 having a mounting portion 36*a* on which the semiconductor light emitting devices 38 are mounted and arranged in an array form, a power supply connector 40, a first interconnecting section 42, and a second interconnecting section 44.

Each of the semiconductor light emitting devices 38 functions as a surface emitting light source. The semiconductor light emitting devices 38 are arranged side by side in one direction such that their light emitting surfaces are faced forward. The light emitting devices 38 are, for example, LEDs, laser diodes (LDs), or electroluminescence (EL) devices. According to the illustrated example, the total of 32 LEDs are arranged in an array form, namely two rows of LEDs arranged one above the other, with 16 LEDs arranged side by side in the lateral direction in each of the rows.

The power supply connector 40 (an example of a power supply portion) is provided to extend along one side 36*b* of the circuit board 36, and is configured to receive external power. The power supply connector 40 is disposed in an upper area on the circuit board 36, and the light emitting devices 38 are disposed in a lower area on the circuit board 36.

A connector portion of a wiring cord 48, which is connected to a control circuit 46 (an example of a control unit) disposed inside the lamp chamber 18, is connected to the power supply connector 40. Therefore, the power is supplied from the control circuit 46 to each of the light emitting devices 38 via the wiring cord 48, the power supply connector 40, the first interconnecting section 42, and the second interconnecting section 44. The control circuit 46 controls the light emitting devices 38 to turn the light emitting devices 38 on and off on a group-by-group basis. In a case in which only one light emitting device 38 is connected to each interconnection 42*a* of the first interconnecting section 42 in the vertical direction, the control circuit 46 controls the light emitting devices 38 one by one. In addition to the turning on and off of the light emitting devices 38, the control circuit 46 may be configured also control the light emitting amount of the respective light emitting devices 38.

The first interconnecting section 42 includes a plurality of interconnections 42*a*, and one end portion of each of the interconnections 42*a* is connected to the anode side 38*a* of the associated light emitting device 38. The second interconnecting section 44 includes a plurality of interconnections 44*a*, and one end portion of each of the interconnections 44*a* is connected to the cathode side 38*b* of the associated light emitting device 38. According to the illustrated example, the second interconnecting sections 44 are arranged in a bilaterally symmetric manner such that the first interconnecting section 42 is disposed between the second interconnecting sections 44. The light emitting devices 38 may be arranged such that their anode sides are connected to the second interconnecting section 44 and their cathode sides are connected to the first interconnecting section 42.

The second interconnecting section 44 has at least one (two in the example of FIG. 2) collectively interconnecting portion 44*b* to which the other end portion of each of the interconnections number 44*a* is connected. The number of the collectively interconnecting portions 44*b* is smaller than the number of the interconnections 44*a* (16 in the example of FIG. 2) connected to the cathode sides 38*b* of the light emitting devices 38. An end portion 44*a*1 of each of the collectively interconnecting portions 44*b* of the second interconnecting section 44 is connected to the power supply connector 40. That is, the collectively interconnecting portion 44*b* collectively interconnects each of the interconnections 44*a* and the power supply connector 40. The collectively interconnecting portion 44*b* has a bent portion 44*b*1 at its bottom-left or bottom-right portion. The other end portion 42*a*1 of each of the interconnections 42*a* of the first interconnecting section 42 is connected to the power supply connector 40.

The wiring pattern of the first interconnecting section 42 and the second interconnecting section 44 is configured such the light emitting devices 38 divided into a plurality of groups corresponding to the respective interconnections 42*a* are independently controllable to be turned on and off on a group-by-group basis. More specifically, according to the illustrated example, the first interconnecting section 42 has a plurality of series-connecting interconnections 42*a*, each of the interconnections 42*a* connecting an associated terminal of the power supply connector 40 to two associated light emitting devices 38 in series, and the interconnections 42*a* are arranged in parallel with each other. This makes it possible to control the turning on and off of the light emitting devices 38 on a group-by-group basis, each of the groups corresponding to the associated one of the series-connecting interconnections 42*a*.

The series-connecting interconnections may be connected such that interconnection heat generation amounts are adjusted in an equalizing manner in accordance with a distribution of currents flowing through the respective series-connecting interconnections. When using the light emitting module 34 in a vehicle headlamp, to produce an intended light distribution pattern, it is designed such that a relatively large current flow through the central interconnection, thereby providing high luminance at the central region in the longitudinal direction of the light emitting area. For example, in a case in which a current of 1200 mA flows through one of the series-connecting interconnections located at the center of the light emitting area and currents of 200 mA, 300 mA and 400 mA flow, in this order from the laterally outer side, through three of the series-connecting interconnections located in a lateral end portion of the light emitting area, the three series-connecting interconnections located in the lateral end portion may be connected together, but not the series-connecting interconnection at the center. As a result, the current of 1200 mA flowing through the series-connecting interconnection at the center is input to one terminal of the power supply connector 40, and the currents flowing through the three series-connecting interconnections located in the lateral end portion are collected and input to another terminal of the power supply connector 40 as a current of 900 mA so as to be closer to the current flowing through the one central series-connecting interconnection. In this manner, suitable power supply can be performed in view of allowable ampacity of the connector terminals.

According to the light emitting module 34 described above, the number of interconnections can be reduced because the second interconnecting section 44 has the collectively interconnecting portions 44*b* which is smaller in number than the interconnections 44*a* that are connected to the cathode sides 38*b* of the light emitting devices 38. By virtue of the reduction in the number of interconnections, the wiring pattern is simplified and the area of the wiring pattern is reduced, which makes it possible to miniaturize the circuit board 36. Further, because the number of terminals of the power supply connector 40 connected to the collectively interconnecting portion 44*b* is reduced accordingly, the power supply connector 40 can also be miniaturized. As a result, a simple and compact light emitting module can be provided.

As described above, the interconnections 44*a* connected to the cathode sides 38*b* of the light emitting devices 38 are connected to the collectively interconnecting portions 44*b* and then connected to the power supply connector 40 via the bent portions 41*b*1. That is, the interconnections 42*a* connected to the anode sides 38*a* of the light emitting devices 38 and the interconnections 44*a* connected to the cathode sides 38*b* of the light emitting devices 38 are connected to the power supply connector 40 disposed on one side (upper side) of the light emitting devices 38.

Therefore, it is not necessary to separately provide a connector connected to the anode sides of the light emitting devices 38 and a connector which is connected to the cathode sides of the light emitting devices 38, and hence the number of connectors can be reduced. Further, the power supply connector 40 is provided to extend along one side 36*b* of the circuit board 36 and no connector is provided on the opposite side 36*c* of the circuit board 36 (see FIG. 2). Therefore, a space for arranging the connector can be reduced and hence the circuit board 36 can be downsized. The light emitting devices 38 are arranged on a peripheral area on the circuit board 36 along the other side 36*c* of the circuit board 36. Therefore, when arranging the light emitting devices 38 at their optimum positions, there is less need to consider the circuit board 36 interfering with other members. This increases the degree of freedom in arranging the light emitting module 34 in optical design.

Still further, the second interconnecting sections 44 are arranged in a bilaterally symmetric manner. Therefore, the temperature distribution on the circuit board 36 and the interconnections during the light emission from the light emitting devices 38 can be made uniform. This is effective in suppressing the differences in brightness among the light emitting devices 38.

Next, other members of the vehicle lamp 10 will be described. As shown in FIG. 1, a lower reflector 50 is disposed below the light emitting devices 38 mounted on the light emitting module 34 and an upper reflector 52 is disposed above the light emitting devices 38. The lower reflector 50 has, on the side of the light emitting devices 38, an upwardly facing reflecting surface 50*a*. The reflecting surface 50*a* is formed as, for example, a paraboloid surface. The upper reflector 52 has, on the side of the light emitting devices 38, a downwardly facing reflecting surface 52*a*. The reflecting surface 52*a* is formed as, for example, a hyperboloid surface. The reflecting surface 50*a* and the reflecting surface 52*a* forwardly reflect light emitted from each of the light emitting devices 38.

A shade drive mechanism 56 configured to drive a movable shade 54 is disposed below the circuit board 36. The shade drive mechanism 56 has a drive motor 58, a transmission mechanism such as gears, and a flat cable 60. When power is supplied from the control circuit 46 to the drive motor 58 via the flat cable 60 so that the output shaft of the drive motor 58 is rotated, the movable shade 54 is moved via the transmission mechanism connected to the output shaft.

More specifically, the movable shade 54 is rotatable between a shielding position C and a retracted position O. When the movable shade 54 is rotated rearward to the shielding position C, the movable shade 54 shields the light that would otherwise reflected by the lower reflector 50. When the movable shade 54 is rotated forward to the retracted position O, the shielded condition of the lower reflector 50 is removed. Depending on the position of the movable shade 54, the light emitted from the light emitting devices 38 towards the lower reflector 50 is controlled. In this manner, the lamp unit 20 can produce a high-beam light distribution pattern and a partial high-beam light distribution pattern in which a part of the high-beam light distribution pattern is cut.

A lens holder 62 is attached to the front surface of the base portion 26 (see FIG. 1). The lens holder 62 is a hollow cylindrical member which is open on both front and rear sides, and is attached to the base portion 26 so as to surround the light emitting module 34 on which the light emitting devices 38 are arranged.

A projection lens 64 (an example of an optical member) is attached to a front end portion of the lens holder 62. The projection lens 64 has a semispherical shape, and is disposed such that its convex surface is located on the front side. The projection lens 64 is configured to project the light emitted from the light emitting module 34 toward the front of the vehicle such that an image on a focal plane including a rear focal point is inverted. The projection lens 64 is accommodated inside the lamp body 12 together with the light emitting module 34.

The optical axis adjusting mechanism 24 has two aiming screws 66, 68. The aiming screw 66 is disposed at an upper rear location in the lamp chamber 18, and has a rotation manipulation portion 66*a* and a shaft 66*b* extending forward from the rotation manipulation portion 66*a*. A front end portion of the shaft 66*b* is formed with a thread 66*c*.

The rotation manipulation portion 66*a* of the aiming screw 66 is supported rotatably by the rear wall of the lamp body 12, and the thread 66*c* is screwed into the associated upper pivot portion 28 of the holding member 22. When the rotation manipulation portion 66*a* is rotated to rotate the aiming screw 66 connected to the pivot portion 28, the holding member 22 is turned toward a direction corresponding to the rotating direction with the other pivot portions 28 serving as supporting points, whereby the optical axis of the lamp unit 20 is adjusted (aiming adjustment). The aiming screw 68 has a similar function as the aiming screw 66.

Next, the light distribution control of the vehicle lamp 10 will be described. The vehicle body is equipped with a camera (not shown) having an imaging device such as a charge-coupled device (CCD) or the like, and an image of an area that can be irradiated by the vehicle lamp 10 is periodically captured by the camera. Image data of the area is subjected to image processing, whereby an oncoming vehicle, a pedestrian, etc., if any, existing in the area are detected.

Based on this information, the control circuit 46 controls the light emitting devices 38 of the light emitting module 34 to turn the light emitting devices 38 on and off on a group-by-group basis and/or controls the movement of the movable shade 54. In this manner, the vehicle lamp 10 can produce a suitable light distribution pattern adapted to the condition in front of the vehicle.

Figure 3:
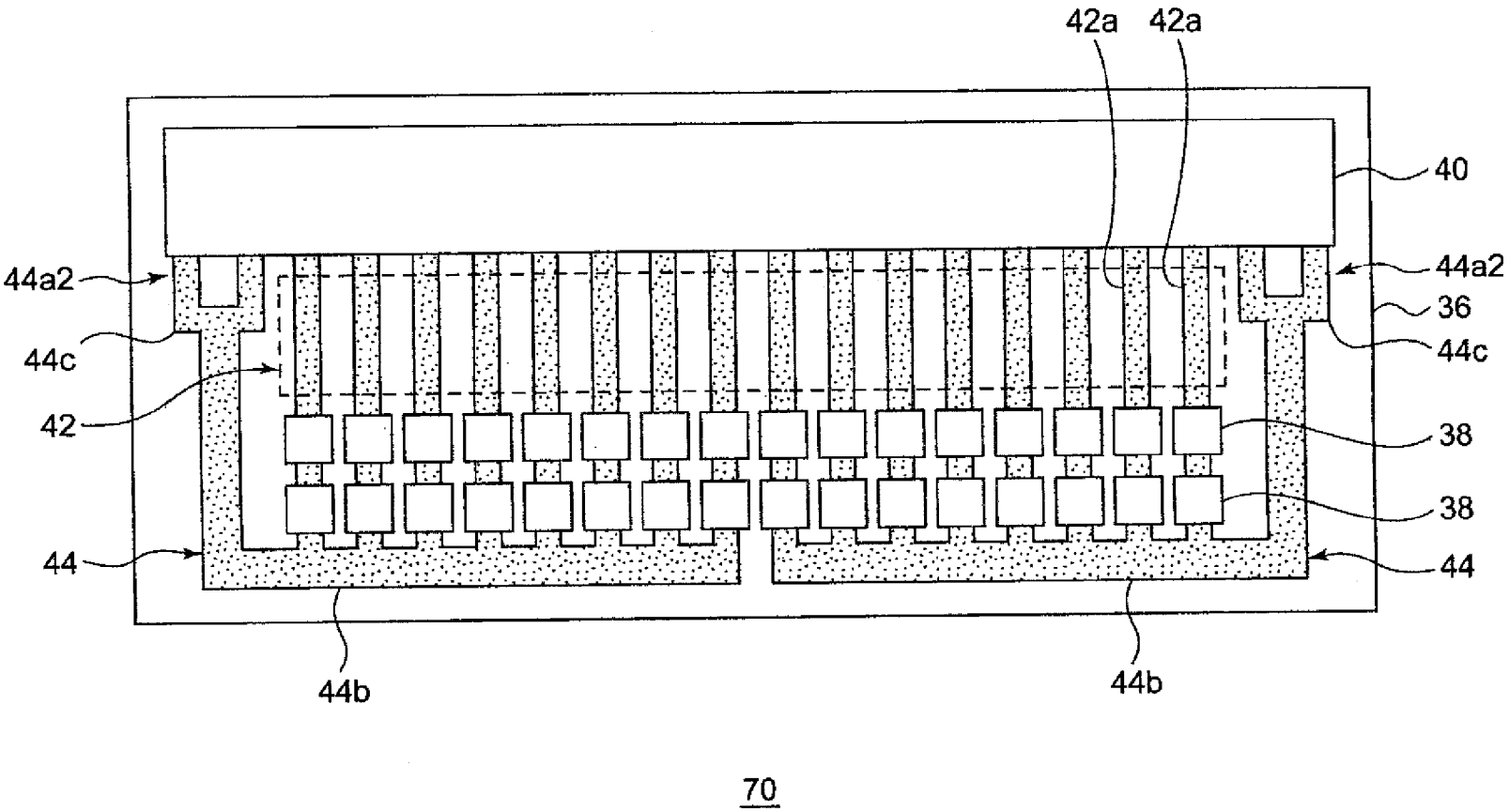
FIG. 3 is a front view of another example of the light emitting module of the vehicle lamp.

FIG. 3 is a front view of another example of the light emitting module 70. In the following description, configurations and advantages that are similar to those of the light emitting module 34 illustrated in FIG. 2 will be omitted.

According to the light emitting module 70, each of the collectively interconnecting portions 44*b* is branched to form a branch portion 44*c* at the end portion 44*a*2 connected to the power supply connector 40. That is, the collectively interconnecting portions 44*b* of the second interconnecting section 44 is connected to the power supply connector 40 at two locations.

Therefore, the amount of current flowing through each branched part of the branch portion 44*c* to the end 44*a*2 of the second interconnecting section 44 is reduced so as to make it closer to the amount of current flowing though each of the interconnections 42*a* of the first interconnecting section 42. That is, suitable power supply can be performed in view of allowable ampacity of the terminals of the power supply connector 40.

Figure 4:
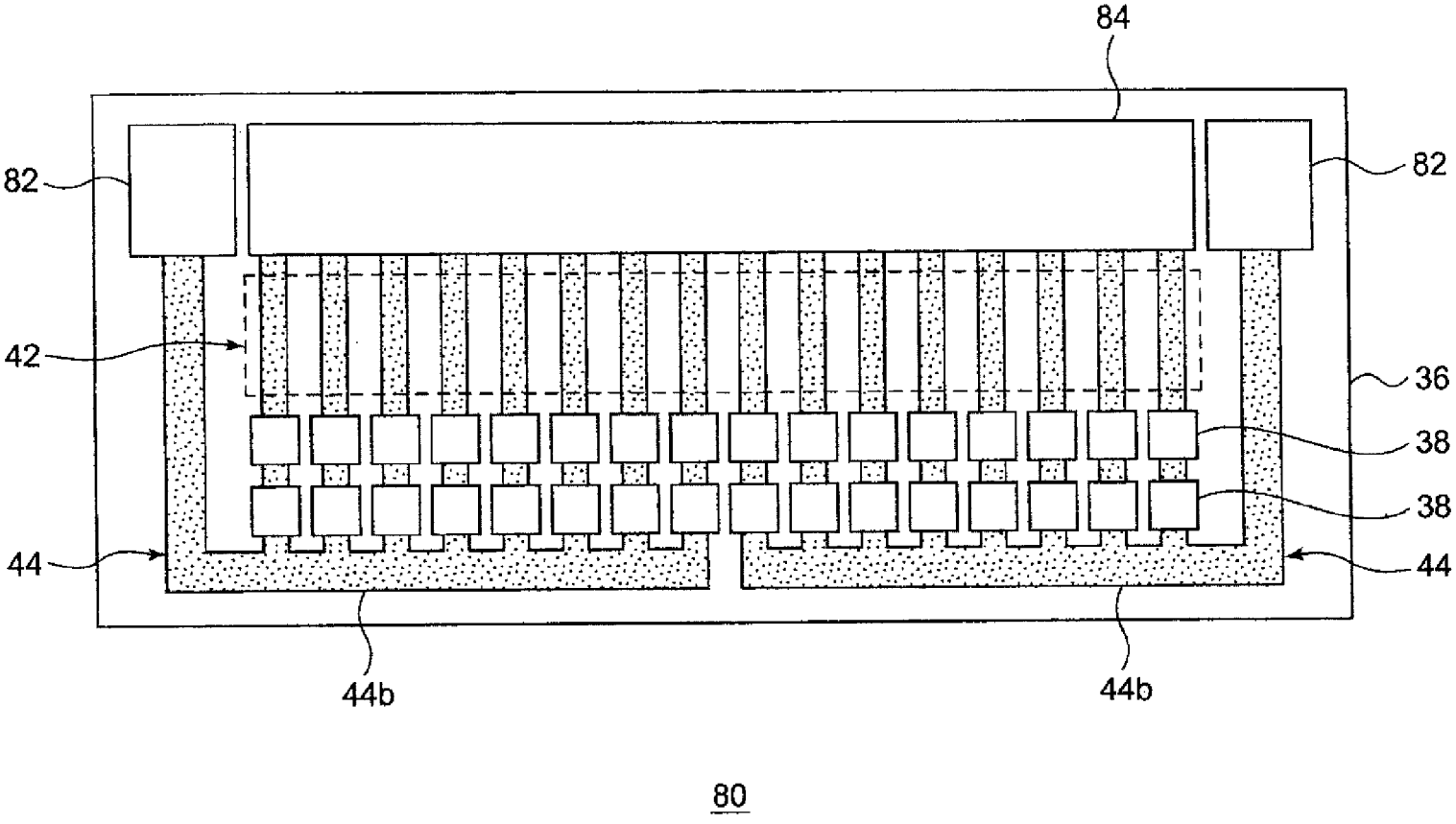
FIG. 4 is a front view of yet another example of the light emitting module of the vehicle lamp.

FIG. 4 is a front view of another example of a light emitting module 80. In the following description, configurations and advantages that are similar to those of the light emitting module 34 illustrated in FIG. 2 will be omitted.

According to the light emitting module 80, the power supply portion has two first connectors 82 connected to the respective collectively interconnecting portions 44*b* of the second interconnecting section 44 and a second connector 84 connected to the first interconnecting section 42. Therefore, the configuration of the power supply portion can be optimized in accordance to the interconnecting section to be connected. More specifically, a connector suitable for the ampacity of each of the interconnections and the number of interconnections can be selected with respect to each of the interconnecting sections.

Figure 5:
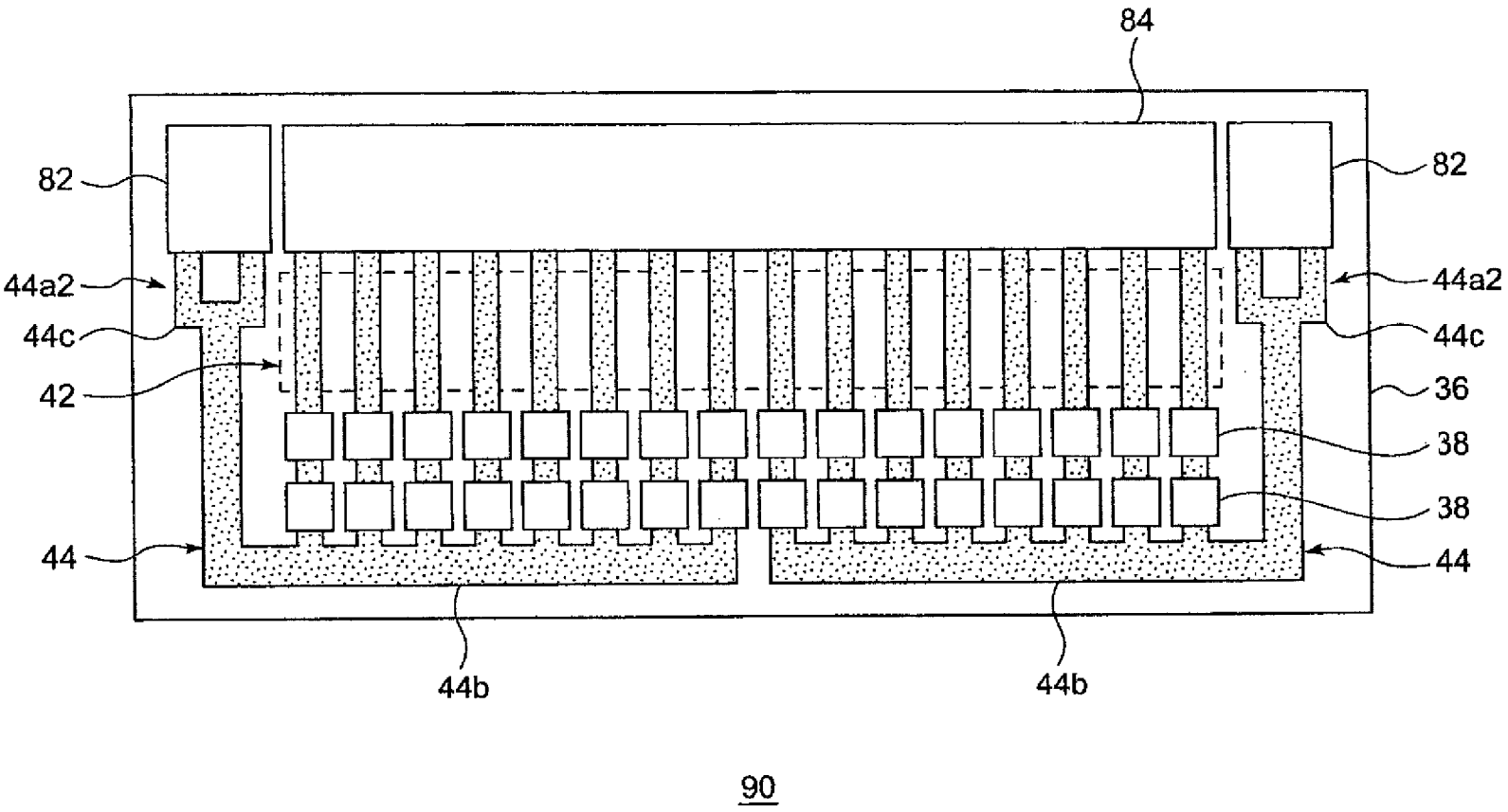
FIG. 5 is a front view of yet another example of the light emitting module of the vehicle lamp.

FIG. 5 is a front view of another example of a light emitting module 90. The light emitting module 90 is based on the light emitting module 34 illustrated in FIG. 2, and each of the second interconnecting section 44 has the branch portion 44*c* of the example illustrated in FIG. 3 and is connected to the corresponding first connector 82 of the example illustrated in FIG. 4. Therefore, the light emitting module 90 provides similar advantages as the light emitting modules 34, 70, and 80 described above.

Because a large current flows through a portion there the interconnections are connected together, like in the collectively interconnecting portions 44*b*, the board may be configured so as to locally improve the heat dissipation performance at the collectively interconnecting portions. For example, through-holes may be formed through the board at a location where the collectively interconnecting portions are formed to transmit heat to the opposite surface (non-mounting surface) of the board. As another example, the circuit board 36 may be provided as a composite board of ceramic and metal, and the metal portion may be arranged directly beneath the collectively interconnecting portions.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A light emitting module comprising:

a board comprising a mounting portion, the mounting portion being configured such that a plurality of light emitting devices, each of the light emitting devices having an anode side and a cathode side, are mounted on the mounting portion in an array form;

a first interconnecting section mounted on a common surface of the board and comprising a plurality of first interconnections, the first interconnections being configured such that one end of each of the first interconnections is connected to one of the anode side and the cathode side of an associated one of the light emitting devices;

a second interconnecting section mounted on the common surface of the board and comprising a plurality of second interconnections, the second interconnections being configured such that one end of each of the second interconnections is connected to the other of the anode side and the cathode side of an associated one of the light emitting devices; and a power supply portion that is a single terminal mounted on the common surface of the board and provided along one side of the common surface of the board and configured to receive an external power, wherein the second interconnecting section further comprises at least one, but less than the number of the second interconnections, collectively interconnecting portion to which another end of each of the second interconnections is connected, wherein the first interconnecting section and the second interconnecting section are configured such that another end of each of the first interconnections and an end portion of the collectively interconnecting portion are connected to the power supply portion, and such that the light emitting devices are divided into a plurality of groups that are independently controllable to be turned on and off, and wherein one end of the second interconnecting section is connected to the power supply portion through the first interconnecting section and the light emitting devices, while the other end of the second interconnecting section is connected directly to the power supply portion.

2. The light emitting module according to claim 1, wherein each of the first interconnections is configured to connect an associated terminal of the power supply portion and the associated one or more of the light emitting devices in series, and the first interconnections are arranged in parallel with each other.

3. The light emitting module according to claim 1, wherein the end portion of the collectively interconnecting portion is branched to form a branch portion connected to the power supply portion.

4. The light emitting module according to claim according to claim 1, wherein the power supply portion comprises a first connector connected to the second interconnecting section and a second connector connected to the first interconnecting section.

5. The light emitting module according to claim 1, further comprising the light emitting devices mounted on the mounting portion.

6. A vehicle lamp comprising:

a light emitting module;

a control unit;

an optical member configured to forwardly project light emitted from the light emitting module; and a lamp body accommodating the light emitting module and the optical member, wherein light emitting module comprises:

a board comprising a mounting portion, the mounting portion being configured such that a plurality of light emitting devices, each of the light emitting devices having an anode side and a cathode side, are mounted on the mounting portion in an array form;

a first interconnecting section mounted on a common surface of the board and comprising a plurality of first interconnections, the first interconnections being configured such that one end of each of the first interconnections is connected to one of the anode side and the cathode side of an associated one of the light emitting devices;

a second interconnecting section mounted on the common surface of the board and comprising a plurality of second interconnections, the second interconnections being configured such that one end of each of the second interconnections is connected to the other of the anode side and the cathode side of an associated one of the light emitting devices; and a power supply portion that is a single terminal mounted on the common surface of the board and provided along one side of the common surface of the board and configured to receive an external power, wherein the second interconnecting section further comprises at least one, but less than the number of the second interconnections, collectively interconnecting portion to which another end of each of the second interconnections is connected, wherein the first interconnecting section and the second interconnecting section are configured such that another end of each of the first interconnections and an end portion of the collectively interconnecting portion are connected to the power supply portion, and such that the light emitting devices are divided into a plurality of groups that are independently controllable to be turned on and off, wherein the control unit is configured to control each of the groups to turn the light emitting devices on and off on a group-by-group basis, and wherein one end of the second interconnecting section is connected to the power supply portion through the first interconnecting section and the light emitting devices, while the other end of the second interconnecting section is connected directly to the power supply portion.

7. The light emitting module according to claim 1, wherein an entirety of the board is plane-shaped.

8. The vehicle lamp according to claim 6, wherein an entirety of the board is plane-shaped.

9. The light emitting module according to claim 1, wherein the mounting portion is part of a surface of the board.

10. The vehicle lamp according to claim 6, wherein the mounting portion is part of a surface of the board.

* * * * *